United States Patent [19]

Rodman

[11] Patent Number: 4,506,391

[45] Date of Patent: Mar. 26, 1985

[54] CHAPS

[76] Inventor: Fred K. Rodman, 16441 12th Ave. South, Seattle, Wash. 98148

[21] Appl. No.: 495,990

[22] Filed: May 19, 1983

[51] Int. Cl.[3] ..... A41D 1/06

[52] U.S. Cl. ..... 2/227; D3/17

[58] Field of Search ..... 2/227, 228, 79, 80, 2/83, 231; D2/9, 27, 28, 33, 190; D3/17, 26

[56] References Cited

U.S. PATENT DOCUMENTS

| | | | |
|---|---|---|---|
| D. 86,602 | 3/1932 | Hicks | D2/28 |
| D. 87,017 | 5/1932 | Morand | D2/33 |
| D. 156,400 | 12/1949 | Beatty | D3/17 |
| D. 201,861 | 8/1965 | Cummins | D3/26 |
| D. 210,190 | 2/1968 | Garcia | D2/27 |
| 222,708 | 12/1879 | Jones | 2/231 |
| 331,959 | 12/1885 | Goldsmith | 2/227 |
| 1,788,195 | 1/1931 | Iskin | 2/227 |
| 2,520,026 | 8/1950 | Beitchman | 2/227 |
| 2,627,604 | 2/1953 | Schor | 2/79 |
| 4,458,363 | 7/1984 | Harvey | 2/22 |

*Primary Examiner*—H. Hampton Hunter

*Attorney, Agent, or Firm*—Joan H. Pauly; Delbert J. Barnard

[57] ABSTRACT

Two main pieces (3, 4) each include a leg encircling portion (6) and an upper portion (12, 16). Each leg portion (6) has a side zipper (8) with a cover flap (10). The front of the leg portion (6) is a downward continuation of the upper portion (12, 16). Upper portion (16) has a front edge (18) that overlaps a front flap (14) on upper portion (12). Flap (14) and edge (18) slide with respect to each other in response to movements of the wearer. The overlap is sufficient to maintain coverage for the abdomen of the wearer. Alternatively, flap (14') may overlap edge (18'). Flap (14') is held in position by being received into a laterally opening patch pocket (20'). A belt (32) is secured to upper portions (12, 16) and has a front buckle (40) for adjusting the amount of overlap of flap (14) and edge (18) and a rear buckle (44) for adjusting the overall fit of the chaps (2).

13 Claims, 7 Drawing Figures

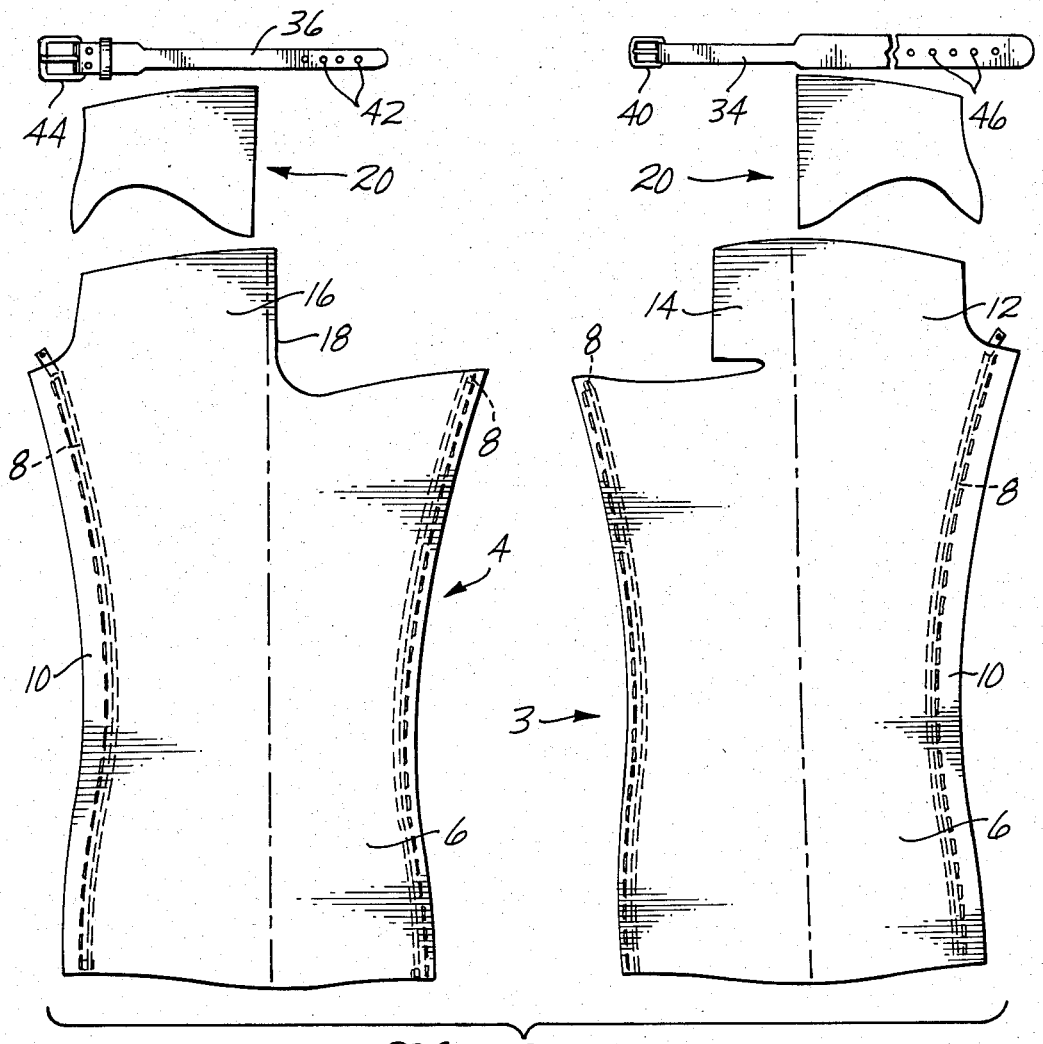
Fig. 3
Fig. 4
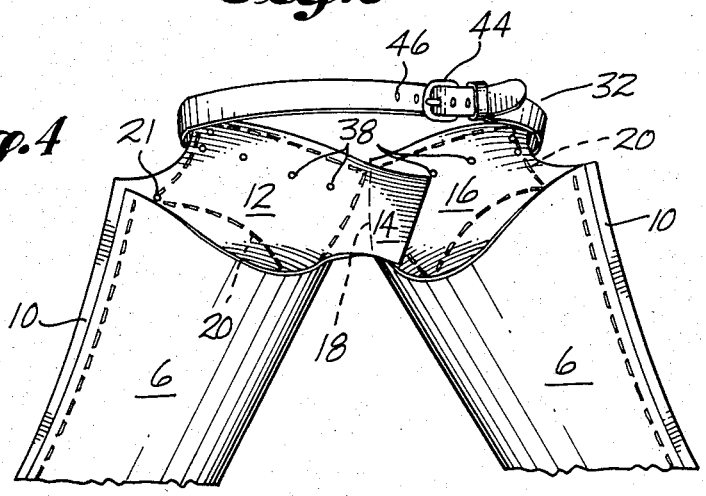

Fig. 5
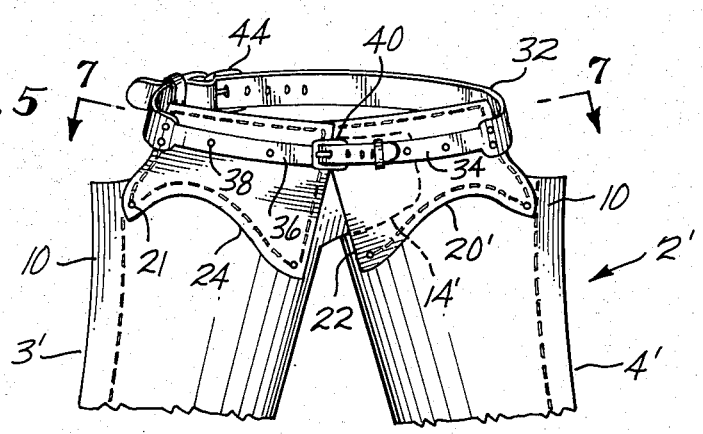
Fig. 6
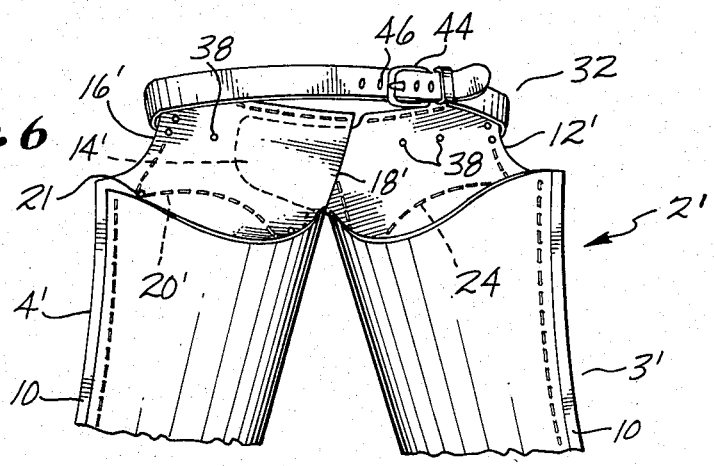
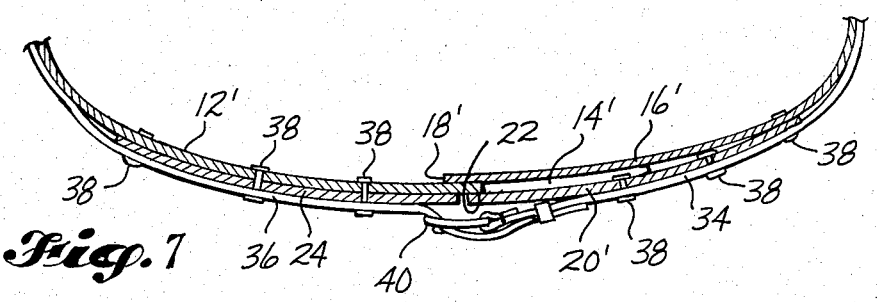
Fig. 7

CHAPS

DESCRIPTION

1. Technical Field

This invention relates to chaps and, more particularly, to chaps with overlapping top front portions that slide with respect to each other to allow the wearer freedom of movement while keeping the abdomen of the wearer covered.

2. Background Art

This invention is directed primarily toward providing chaps for use when riding a motorcycle that provide adequate protection for the wearer without restricting the freedom of movement of the wearer. In order to provide adequate protection for a motorcycle rider, chaps should cover at least the front portions of his legs (and preferably the entire legs) and his abdomen. Adequate protection also calls for the chaps to be made from a material that is highly resistant to abrasions and punctures.

Conventional chaps have an open front upper portion or are made like ordinary pants. Since materials that meet the above requirements are generally heavy and relatively stiff, conventional chaps that are like ordinary pants and that are made from such materials tend to restrict the movements of the wearer. In the past, freedom of movement has been provided by decreasing the degree of protection by making the chaps from a lighter material or decreasing the amount of coverage provided by the chaps (such as by making the chaps permanently open in front). This is at best a poor compromise since the chaps are rendered at least partially ineffective for accomplishing their major purpose—protection of the wearer.

U.S. Pat. No. Des. 156,400, granted Dec. 13, 1949, to S. F. Beatty discloses a pair of gardening chaps. These chaps provide neither the kind of protection nor the degree of freedom of movement required by a motorcycle rider. U.S. Pat. No. Des. 201,861, granted Aug. 10, 1965, to G. E. Cummins and U.S. Pat. No. Des. 210,190, granted Feb. 20, 1968, to R. J. Garcia each disclose a protective garment for the legs of the wearer. Although each of the garments disclosed in these two patents provides considerable freedom of movement, neither provides the kind of protection needed by a motorcycle rider. The United States patent literature also includes a number of utility patents directed toward various types of garments. These garments are of general interest only relative to the present invention. They include the pajamas disclosed in U.S. Pat. No. 2,520,026, granted Aug. 22, 1950, to M. I. Beitchman and the child's overalls disclosed in U.S. Pat. No. 2,627,604, granted Feb. 10, 1953, to P. B. Schor.

The above patents and the prior art that is discussed and/or cited therein should be studied for the purpose of putting the present invention into proper perspective relative to the prior art.

DISCLOSURE OF THE INVENTION

The subject of this invention is a pair of chaps for use when riding a motorcycle, a horse, or the like. According to a basic aspect of the invention, the chaps comprise two leg portions, two upper portions, means for limiting movement of the upper portions with respect to each other, and means for supporting the chaps in position on a wearer. Each of the leg portions extends downwardly from a different one of the upper portions and is positioned to cover at least the front and part of the sides of the wearer's leg. One of the upper portions includes front flap means and the other of the upper portions includes front edge means. One of the flap and edge means slidably overlaps the other of the flap and edge means to cover the abdomen of the wearer. When a wearer moves one leg with respect to the other leg, the flap means and the edge means slide with respect to each other to allow the wearer freedom of movement. The amount of overlap of the flap and edge means is sufficient to maintain the flap and edge means in an overlapping position when the wearer mounts and dismounts a motorcycle or a horse.

According to an aspect of the invention, the means for limiting movement comprises a fastener having a first portion carried by one of the upper portions of the chaps and a second portion carried by the other of the upper portions to engage the first portion. This fastener provides a front connection between the upper portions that is sufficiently loose to allow the flap means and edge means to slide with respect to each other and sufficiently restrictive to maintain the flap and edge means in an overlapping position when the wearer mounts and dismounts a motorcycle or a horse. Preferably, the two upper portions are separable and the connection provided by the fastener is adjustable to allow the wearer to adjust the amount of overlap of the flap and edge means. The preferred embodiment of the adjustable fastener comprises first and second flexible straps and a buckle. The first flexible strap is attached to a top portion of one of the upper portions and has a free end. The buckle is attached to this free end. The second flexible strap is attached to a top portion of the other of the upper portions and has a free end with a plurality of holes for adjustably engaging the buckle.

According to another aspect of the invention, the means for supporting the chaps comprises belt means which engages a top portion of each of the upper portions of the chaps and which includes two free ends that adjustably engage each other.

According to a preferred aspect of the invention, the means for supporting the chaps comprises a second free end of the first flexible strap, a second buckle attached to said second free end, and a second free end of the second flexible strap with a plurality of holes for adjustably engaging the second buckle.

In one of the preferred embodiments of the invention, the edge means comprises a front edge of said other upper portion positioned to extend generally downwardly along substantially the middle of the abdomen of the wearer from the top of said other upper portion substantially to the top of the corresponding leg portion. In this embodiment, the flap means comprises a laterally extending flap and the front edge overlaps the flap substantially from the top of the chaps to the top of said corresponding leg portion.

In a second preferred embodiment of the invention, the edge means comprises a front edge of said other upper portion positioned to extend generally downwardly along a midportion of the abdomen of the wearer from the top of said other upper portion substantially to the top of the corresponding leg portion. The flap means comprises a laterally extending flap. The flap overlaps the front edge substantially from the top of the chaps to the top of said corresponding leg portion. This embodiment further comprises a patch pocket on the outside of said other upper portion with a laterally directed opening for receiving the flap to hold the flap in position adjacent to said other upper portion.

According to another basic aspect of the invention, the chaps comprise two upper portions, two leg encircling portions each of which has a front portion that is a downward continuation of a different one of said upper portions, means for limiting movement of said upper portions with respect to each other, and means for supporting the chaps in position on a wearer. One of the upper portions includes front flap means and the other of the upper portions includes front edge means. One of said flap and edge means slidably overlaps the other of said flap and edge means to cover the abdomen of a wearer. When a wearer moves one leg with respect to the other leg, the flap means and the edge means slide with respect to each other to allow the wearer freedom of movement. The amount of overlap of the flap and edge means is sufficient to maintain the flap and edge means in an overlapping position when the wearer mounts and dismounts a motorcycle or a horse.

According to an aspect of the invention, each of the leg encircling portions has two side edges extending along its entire vertical length, and the chaps further comprise a zipper to releasably connect the two side edges of each leg encircling portion. Preferably, each leg encircling portion includes a laterally extending cover flap along the length of one of its side edges. This cover flap overlaps the corresponding zipper when the side edges of the leg encircling portion are connected to prevent water and debris from contacting the zipper and to protect the leg of the wearer.

A preferred feature of the invention is the provision of a reinforcing panel attached to the outside of each of the upper portions. The panel has a top edge substantially adjacent to at least part of the top edge of the upper portion. The panel strengthens the upper portion and increases its resistance to stretching. In embodiments of the invention in which the flap means comprises a laterally extending flap that overlaps the edge means, the reinforcing panel attached to said other upper portion preferably has a laterally directed opening to form a patch pocket for receiving the flap to hold the flap in position adjacent to said other upper portion.

Chaps constructed according to the invention solve the problem of providing a protective garment for motorcycle riders that allows freedom of movement without sacrificing the degree of protection afforded by the garment. When a rider mounts and dismounts and rides a motorcycle, the sliding movement of the flap and edge means with respect to each other allows the chaps to move with him so that the chaps will not interfere with his freedom of movement. At the same time, the flap and edge means remain in an overlapping position so that his front lower torso remains covered and protected by the chaps. The freedom of movement and protection of the front of the wearer are maintained regardless of whether the leg portions are open in the back or encircle the legs of the wearer.

Chaps constructed according to the invention are comfortable and provide much greater protection for the wearer than conventional protective garments. In chaps with the preferred feature of a fastener that provides an adjustable front connection between the upper portions, the wearer can loosen the front connection if he desires for greater comfort or he can increase the overlap of the flap and edge means when greater protection is desired, such as when it is raining. In the preferred embodiment which includes two flexible straps and two buckle connections, these adjustments can be made quickly and easily and the second buckle connection can be loosened or tightened if necessary to maintain the overall fit of the chaps when the first buckle is adjusted. The flexible strap and double buckle arrangement adds to the comfort of the wearer while maintaining the protection provided by the chaps. The first buckle provides a secure connection between the two top portions that is sufficiently flexible to allow the kind of sliding movement of the flap and edge means that is necessary to maintain the wearer's freedom of movement, and the second buckle allows adjustment of the overall fit of the chaps without affecting the overlap of the flap and edge means.

These and other advantages and features will become apparent from the detailed description of the best modes for carrying out the invention that follows.

BRIEF DESCRIPTION OF THE DRAWINGS

In the drawings, like element designations refer to like parts throughout, and:

FIG. 3 is an exploded elevational view of the chaps shown in FIGS. 1 and 2.

FIG. 4 is like the top portion of FIG. 2 except that it shows the legs and front flap and edge portions of the chaps in a spread position.

FIG. 5 is a front elevational view of a top portion of the second preferred embodiment of the invention.

FIG. 6 is a rear elevational view of a top portion of the chaps shown in FIG. 5.

FIG. 7 is a sectional view taken along the line 7—7 in FIG. 5.

BEST MODES FOR CARRYING OUT THE INVENTION

Figure 1:
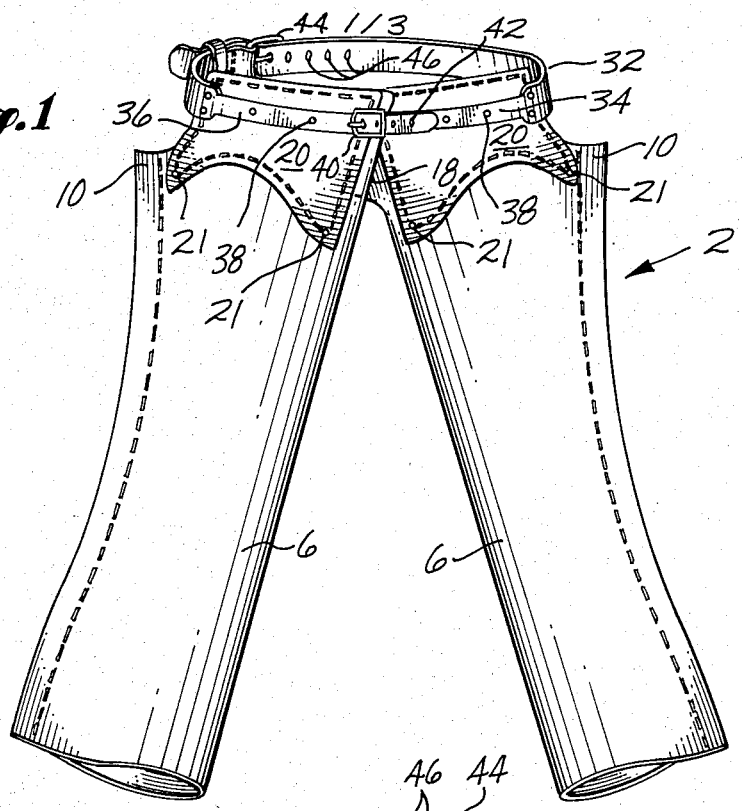
FIG. 1 is a front elevational view of the first preferred embodiment of the invention.

The drawings show two embodiments of chaps 2, 2' that are constructed according to the invention and that also constitute the best modes of the invention currently known to the applicant. FIGS. 1–4 show a first preferred embodiment in which the upper or body portions 12, 16 of the chaps 2 include a flap 14 that is overlapped by an edge 18. FIGS. 5–7 show a second preferred embodiment in which the upper or body portions 12', 16' of the chaps 2' include a flap 14' that overlaps an edge 18'.

Referring first to FIGS. 1–4, the chaps 2 include two main pieces 3, 4, one of which covers the right leg and the lower right front torso of the wearer and the other of which covers the left leg and the lower left front torso. These two main pieces 3, 4 may be permanently connected together, such as by a rivet at the center top, but in the preferred embodiments the two pieces are separable.

Figure 2:
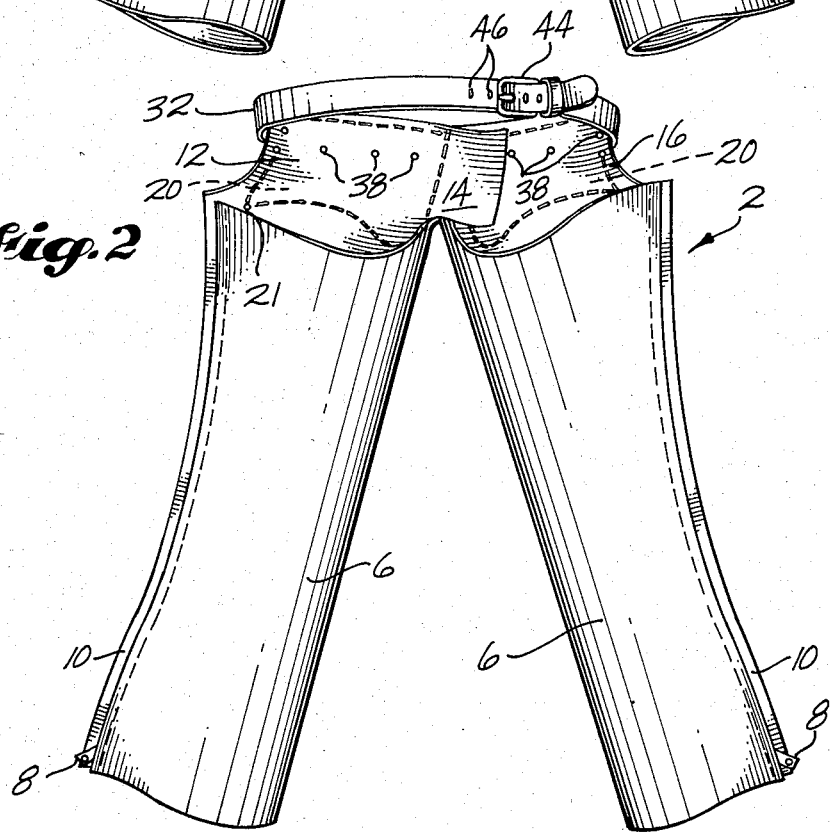
FIG. 2 is a rear elevational view of the chaps shown in FIG. 1.

Each of the two main pieces 3, 4 includes a leg portion 6. As shown in the drawings, the leg portions 6 of the preferred embodiments completely encircle the legs of the wearer to maximize the protection afforded to the legs. As shown in FIGS. 1–3, the leg portions 6 are contoured for a fairly snug but comfortable fit on the wearer. The exact shape of the leg portions of course can be varied considerably without departing from the spirit and scope of the invention. However, it is preferable to provide a fairly snug fit on the upper and mid portions of the leg to avoid unnecessary bulk, and to provide some flaring at the bottom of the leg for ease of movement.

In order to make it easier to put on and take off the chaps 2, each leg 6 is provided with a side zipper 8. This zipper 8 releasably connects two side edges of the leg 6 which extend along the entire vertical length of the leg 6. The zipper 8 is preferably the type that separates when it is unzipped and preferably zips from the top to the bottom of the leg 6. The complete separation of the side edges makes it easier to put the chaps 2 on, and the top to bottom zipping action makes it easier to zip the side edges of the legs 6 together. As is shown in FIG. 3, when the zipper 8 is unzipped and separated, the entire main portions 3, 4 of the chaps 2 may be laid flat.

In the preferred embodiments shown in the drawings, each leg 6 has a laterally and backwardly extending cover flap 10 along the length of the forward side edge. Preferably, this cover flap 10 is an integral extension of the leg portion 6. The cover flap 10 overlaps the zipper 8 when the side edges of the leg portion 6 are connected. This prevents water and debris from contacting the zipper 8 and possibly damaging or clogging the zipper 8 and also provides extra protection for the leg of the wearer.

In addition to the leg portion 6, each of the two main pieces 3, 4 of the chaps 2 also includes an upper portion 12, 16. These upper portions 12, 16 cover only the front of the lower body of the wearer and the chaps 2, like conventional chaps, are seatless in that they do not cover the rear portion of the body between the top of the legs and the belt. The front portion of the leg 6 of each main piece 3, 4 is an integral downward continuation of the corresponding upper portion 12, 16.

An important feature of chaps constructed according to the invention is upper portions that include overlapping front flap means and front edge means. In the preferred embodiment shown in FIGS. 1–4, the edge means comprises a front edge 18 of the right upper portion 16 of the chaps 2. (It should be noted that in this description left and right are seen from the point of view of the wearer of the chaps.) The front edge 18 is positioned at about the middle of the abdomen of the wearer and extends generally downwardly from the top of upper portion 16 to about the top of the corresponding leg portion 6. The edge of main piece 4 is curved between front edge 18 and the top of leg 6 in order to provide a smooth transition.

The front flap means of chaps 2 comprises a laterally extending flap 14 that is an integral extension of upper portion 12. Of course flap 14 could be made as a separate piece and attached to upper portion 12, but it is preferable to provide flap 14 as an integral extension to reduce the cost of making the chaps 2 and to avoid undue bulk. In the preferred embodiment of FIGS. 1–4, the front edge 18 overlaps the flap 14 from the top of the chaps 2 to about the top of the corresponding leg portion 6.

In order to allow the wearer freedom of movement, the front edge 18 and flap 14 move with respect to each other when the wearer moves one leg with respect to the other leg. The movement of the flap 14 and edge 18 is basically a sliding movement with the amount of overlap of the flap 14 and edge 18 adjusting to follow the movements of the wearer. FIG. 2 shows the flap 14 and edge 18 in a relatively unspread position, and FIG. 4 shows the flap 14 and edge 18 in a relatively spread position. As can be seen in FIGS. 2 and 4, the overlap increases and decreases more at the bottom of the flap 14 and remains relatively constant at the top of the flap 14. In other words, the sliding movement of the fap 14 and edge 18 with respect to each other is mostly pivotal about an imaginary pivot point near the top of the chaps 2. this imaginary pivot point remains at a top center location on the chaps 2 but does move a small amount up and down and laterally as the wearer moves. Since the chaps 2 are intended to cover and protect the abdomen of the wearer, the amount of overlap of the flap 14 and edge 18 is sufficient to maintain the flap 14 and edge 18 in an overlapping position when the wearer mounts and dismounts a motorcycle or horse, performs other movements necessary for riding a motorcycle or a horse or walks around.

As shown in FIGS. 1–4, the chaps 2 also preferably include a panel 20 attached to the outside of each of the upper portions 12, 16. Each panel 20 has a top edge that generally coincides with a part of the top edge of the corresponding upper portion 12, 16. The panels 20 of the embodiment shown in FIGS. 1–4 are stitched onto the upper portions 12, 16 all around the edges of the panels 20 and serve to strengthen the upper portions 12, 16 and increase their resistance to stretching. In addition to their practical functions, the panels 20 are designed to increase the attractiveness of the chaps 2. The rivets 21 at each of the lower corners of the panels 20 are both ornamental and serve to secure the connection between the panels 20 and the upper portions 12, 16.

The chaps 2 also include means for limiting movement of the upper portions 12, 16 with respect to each other and means for supporting the chaps 2 in position on a wearer. The chaps 2 are provided with a double-buckled belt 32. The belt 32 comprises two flexible straps 34, 36 and two buckles 40, 44. The front portion of each strap 34, 36 is securely attached near the top of the corresponding upper portion 12, 16 by means of rivets 38. Each strap 34, 36 has a free end at about the middle of the front of the chaps 2. A first buckle 40 is attached to one of these free ends, and the other free end has a plurality of holes 42 for adjustably engaging the buckle 40 in the conventional manner. This front buckle connection between the upper portions 12, 16 is sufficiently restrictive to maintain the flap 14 and edge 18 in an overlapping position as the wearer mounts, rides, and dismounts a motorcycle or a horse to in turn keep the abdomen of the wearer covered and protected. On the other hand, the connection is sufficiently loose and flexible to allow the flap 14 and edge 18 to slide with respect to each other to maintain the wearer's freedom of movement.

Each of the flexible straps 34, 36 also has a second free end. The two second free ends encircle the back of the wearer to support the chaps 2 in position on the wearer. Like the first free ends, the second free ends have an adjustable buckle connection including a second buckle 44 on one of said second free ends and a second set of holes 46 on the other of the second ends. The second or rear buckle connection functions in much the same manner as an ordinary belt to support the chaps 2.

As described above, the two buckle connections cooperate with each other to insure the maintenance of the overall fit and comfort of the chaps 2 while permitting the adjustment of the amount of overlap of the flap 14 and edge 18.

The embodiment shown in FIGS. 5–7 has many features in common with the embodiment of FIGS. 1–4 and differs mainly from the embodiment of FIGS. 1–4 in the arrangement of the flap and edge portions of its upper portions 12', 16'. Like the embodiment of FIGS. 1–4, the second embodiment of the chaps 2' includes two main pieces 3', 4', each of which has a leg portion 6. In both embodiments, the front of each leg 6 is a downward continuation of an upper portion and the chaps 2, 2' are seatless. Each embodiment also includes the double-buckled belt 32 described above.

As shown in FIGS. 5–7, the right main piece 3' has an upper portion 12' that includes a laterally extending flap 14'. The left main piece 4' has an upper portion 16' that includes a front edge 18' which extends generally downwardly along a midportion of the abdomen of the wearer from the top of upper portion 16' to about the top of the corresponding leg portion 6. Flap 14' overlaps front edge 18' from about the top of the chaps 2' to about the top of the corresponding leg portion 6. This construction is quite similar to the construction of the embodiment of FIGS. 1–4, but the positioning of the flap 14' on the outside of the chaps 2' requires that some means be provided for holding the flap 14' in position adjacent to upper portion 16'. Undesired separation between flap 14' and upper portion 16' would be annoying to the wearer and would decrease the protection provided to the wearer.

In the preferred embodiment shown in FIGS. 5–7, the flap 14' is held in position by means of a patch pocket 20' on the outside of upper portion 16'. This patch pocket 20' is a modified version of the panel 20 of the embodiment in FIGS. 1–4. Pocket 20' extends slightly more to the middle of the chaps 2' than does panel 20 to the middle of chaps 2 in order to keep flap 14' essentially flat against upper portion 16'. Pocket 20' is not stitched to upper portion 16' along its inner vertical edge in order to provide a laterally directed opening 22 for receiving flap 14'. As the wearer moves, flap 14' slides within the pocket formed by pocket panel 20' and upper portion 16' to follow the movements of the wearer. Pocket panel 20' bulges slightly outwardly from upper portion 16' so that the movement of flap 14' within the pocket is not unduly restricted. In order to maintain the attractiveness of the chaps 2', upper portion 12' is provided with a panel 24 that is symmetrical to pocket 20' except that it is stitched onto upper portion 12' around all of its edges. Both pocket panel 20' and panel 24 serve to reinforce the chaps 2' and to help prevent stretching.

Chaps made according to the invention may be made from a variety of materials. However, the preferred material is heavy leather. This material is preferred because it is highly resistant to abrasions and punctures, it provides good protection against the weather, and it is more comfortable than synthetic materials.

It should be obvious that chaps constructed according to the invention are attractive and comfortable and maximize the protection afforded a rider of a motorcycle or a horse. A wearer is protected from the elements, including rain and cold, when he is mounted on the motorcycle or horse, is riding the motorcycle or horse, or has dismounted. Should the wearer be thrown or fall from the motorcycle or horse, the protection the chaps provide against abrasions and punctures can mean the difference between serious injury and no injury or very minor injury. The maintenance of the wearer's freedom of movement not only adds to his comfort but also adds to his safety since he will be better able to maneuver to avoid accidents.

Throughout the description of the structure and use of the preferred embodiments of the chaps of this invention, the terms "downwardly", "upper", "vertical" and the like have been used. These terms have been used to indicate the position of the wearer and the chaps in a typical use position in which the wearer is standing. The terms are not intended to indicate that the wearer's movements or positioning are in any way restricted, and it is intended to be understood that as the wearer moves the chaps of course move with him and, for example, "vertical" may become horizontal.

Although the invention has been described in connection with a specific environment, it will obvious to those skilled in the art to which this invention is addressed that the invention may be used to advantage in a variety of situations. It should also be obvious to those skilled in the art that various changes, modifications, and omissions in form and detail may be made without departing from the spirit and scope of the present invention as defined by the following claims.

What is claimed is:

1. A pair of chaps for use when riding a motorcycle, a horse, or the like, comprising two leg portions, two upper portions, means for limiting movement of said upper portions with respect to each other, and means for supporting the chaps in position on a wearer; each of said leg portions extending downwardly from a different one of said upper portions and being positioned to cover at least the front and part of the sides of a wearer's leg; one of said upper portions including front flap means and the other of said upper portions including front edge means, with one of said flap and edge means slidably overlapping the other of said flap and edge means to cover the abdomen of a wearer; wherein when a wearer moves one leg with respect to the other leg, the flap means and the edge means slide with respect to each other to allow the wearer freedom of movement; and wherein the amount of overlap of the flap and edge means is sufficient to maintain the flap and edge means in an overlapping position when the wearer mounts and dismounts a motorcycle or a horse.

2. Chaps as described in claim 1, in which the means for limiting movement comprises a fastener having a first portion carried by one of the upper portions of the chaps, and a second portion carried by the other of said upper portions to engage said first portion; said fastener providing a front connection between said upper portions that is sufficiently loose to allow the flap means and edge means to slide with respect to each other and sufficiently restrictive to maintain the flap and edge means in an overlapping position when the wearer mounts and dismounts a motorcycle or a horse.

3. Chaps as described in claim 2, in which the two upper portions are separable, and the connection provided by said fastener is adjustable to allow the wearer to adjust the amount of overlap of the flap and edge means.

4. Chaps as described in claim 3, in which said fastener comprises a first flexible strap attached to a top portion of one of said upper portions and having a free end, a buckle attached to said free end, and a second flexible strap attached to a top portion of the other of said upper portions and having a free end with a plurality of holes for adjustably engaging the buckle.

5. Chaps as described in claim 1, in which the means for supporting the chaps comprises belt means which engages a top portion of each of the upper portions of the chaps and which includes two free ends that adjustably engage each other.

6. Chaps as described in claim 4, in which the means for supporting the chaps comprises a second free end of the first flexible strap, a second buckle attached to said second free end, and a second free end of the second flexible strap with a plurality of holes for adjustably engaging the second buckle.

7. Chaps as described in claim 1, in which the edge means comprises a front edge of said other upper portion positioned to extend generally downwardly along substantially the middle of the abdomen of the wearer from the top of said other upper portion substantially to the top of the corresponding leg portion, the flap means comprises a laterally extending flap, and the front edge overlaps the flap substantially from the top of the chaps to the top of said corresponding leg portion.

8. Chaps as described in claim 1:

in which the edge means comprises a front edge of said other upper portion positioned to extend generally downwardly along a midportion of the abdomen of the wearer from the top of said other upper portion substantially to the top of the corresponding leg portion, the flap means comprises a laterally extending flap, and the flap overlaps the front edge substantially from the top of the chaps to the top of said corresponding leg portion; and which further comprise a patch pocket on the outside of said other upper portion with a laterally directed opening for receiving the flap to hold the flap in position adjacent to said other upper portion.

9. A pair of chaps for use when riding a motorcycle, a horse, or the like, comprising two upper portions, two leg encircling portions each of which has a front portion that is a downward continuation of a different one of said upper portions, means for limiting movement of said upper portions with respect to each other, and means for supporting the chaps in position on a wearer; one of said upper portions including front flap means and the other of said upper portions including front edge means, with one of said flap and edge means slidably overlapping the other of said flap and edge means to cover the abdomen of a wearer; wherein when a wearer moves one leg with respect to the other leg, the flap means and the edge means slide with respect to each other to allow the wearer freedom of movement; and wherein the amount of overlap of the flap and edge means is sufficient to maintain the flap and edge means in an overlapping position when the wearer mounts and dismounts a motorcycle or a horse.

10. Chaps as described in claim 9, in which each of the leg encircling portions has two side edges extending along its entire vertical length; and which further comprise a zipper to releasably connect the two side edges of each leg encircling portion.

11. Chaps as described in claim 10, in which each leg encircling portion includes a laterally extending cover flap along the length of one of its side edges, which cover flap overlaps the corresponding zipper when the side edges of the leg encircling portion are connected to prevent water and debris from contacting the zipper and to protect the leg of the wearer.

12. Chaps as described in claim 9, further comprising a reinforcing panel attached to the outside of each of the upper portions, said panel having a top edge substantially adjacent to at least part of the top edge of the upper portion, wherein said panel strengthens the upper portion and increases its resistance to stretching.

13. Chaps as described in claim 12, in which the edge means comprises a front edge of said other upper portion positioned to extend generally downwardly along a midportion of the abdomen of the wearer from the top of said other upper portion substantially to the top of the corresponding leg portion, the flap means comprises a laterally extending flap, the flap overlaps the front edge substantially from the top of the chaps to the top of said corresponding leg portion, and the reinforcing panel attached to said other upper portion has a laterally directed opening to form a patch pocket for receiving the flap to hold the flap in position adjacent to said other upper portion.

* * * * *